US012256809B2

(12) United States Patent
Pence et al.

(10) Patent No.: US 12,256,809 B2
(45) Date of Patent: Mar. 25, 2025

(54) ADJUSTABLE CLOG STYLE FOOTWEAR

(71) Applicants: Nicholas Pence, Missoula, MT (US); Daniel Opalacz, Missoula, MO (US)

(72) Inventors: Nicholas Pence, Missoula, MT (US); Daniel Opalacz, Missoula, MO (US)

( * ) Notice: Subject to any disclaimer, the term of this patent is extended or adjusted under 35 U.S.C. 154(b) by 0 days.

(21) Appl. No.: 18/386,635

(22) Filed: Nov. 3, 2023

(65) Prior Publication Data

US 2024/0057721 A1 Feb. 22, 2024

Related U.S. Application Data

(63) Continuation of application No. 17/567,826, filed on Jan. 3, 2022, now Pat. No. 11,805,858.

(51) Int. Cl.

| | |
|---|---|
| ***A43B 3/10*** | (2006.01) |
| ***A43B 1/14*** | (2006.01) |
| ***A43C 1/04*** | (2006.01) |
| ***A43C 7/00*** | (2006.01) |
| *A43B 3/12* | (2006.01) |

(52) U.S. Cl.

CPC ..... *A43C 7/00* (2013.01); *A43B 1/14* (2013.01); *A43B 3/108* (2013.01); *A43C 1/04* (2013.01); *A43B 3/122* (2013.01); *A43B 3/128* (2013.01)

(58) Field of Classification Search

CPC .. A43B 1/06; A43B 1/14; A43B 3/106; A43B 3/12; A43B 3/122

See application file for complete search history.

(56) References Cited

U.S. PATENT DOCUMENTS

| | | | |
|---|---|---|---|
| 2,193,943 | A | 3/1940 | Shea |
| 3,978,596 | A | 9/1976 | Brown |
| 4,793,075 | A | 12/1988 | Thatcher |
| 4,869,000 | A | 9/1989 | York |
| 5,205,054 | A | 4/1993 | York |

(Continued)

OTHER PUBLICATIONS

Jarvis, Shamma, Sandals Mountain Goats Review, Barefoot Shoes, Sep. 25, 2014, downloaded from https://birthdayshoes.com/shamma-sandals-mountain-goats-review on May 4, 2017.

(Continued)

*Primary Examiner* — Katharine G Kane

(74) *Attorney, Agent, or Firm* — Richard A. Baker, Jr.

(57) ABSTRACT

An adjustable clog with a unique strap system is described. The sole assembly for the clog has an interior sole wing situated near the heel of the sole assembly, and an exterior sole wing on the opposite side of the sole assembly from the interior sole wing, near the heel of the sole assembly, wherein the interior sole wing and the exterior sole wing consist of webbing strap and rubber that extend above the sole assembly. The clog also includes an upper, where the upper is affixed to the sole assembly. A wing hook strap is affixed to the interior sole wing on the first end of the wing hook strap and to the paracord loop on the second end of the wing hook strap, wherein the wing hook strap includes a first G-hook that hooks into one of the first plurality of hook pockets. A heel strap connected to the interior sole wing on the first end of the heel strap and the exterior sole wing on the second end of the heel strap through the mechanical ring, said heel strap includes a second G-hook that hooks into one of the second plurality of hook pockets.

19 Claims, 6 Drawing Sheets

(56) References Cited

U.S. PATENT DOCUMENTS

| | | | | |
|---|---|---|---|---|
| 5,228,216 | A | 7/1993 | Sargent | |
| 5,423,134 | A | 6/1995 | Bagnaia | |
| 5,438,767 | A | 8/1995 | Stein | |
| 5,659,978 | A | 8/1997 | Bell | |
| 6,086,451 | A | 7/2000 | Fernandes | |
| 6,237,250 | B1 | 5/2001 | Aguerre | |
| D495,855 | S | 9/2004 | Comeau | |
| 6,968,634 | B2 | 11/2005 | Dombowsky | |
| 7,103,993 | B2 | 9/2006 | Sakai | |
| 7,121,020 | B1 | 10/2006 | Bathum | |
| 7,146,751 | B2 * | 12/2006 | Seamans | A43B 1/14 36/11.5 |
| 7,222,440 | B2 | 5/2007 | Dombowsky | |
| 7,819,721 | B1 | 10/2010 | Messier | |
| 8,250,730 | B2 | 8/2012 | Diaz | |
| 8,250,780 | B1 | 8/2012 | Diaz | |
| 8,381,415 | B1 | 2/2013 | Lanoue | |
| 8,523,629 | B2 | 9/2013 | Pundyk | |
| 9,510,638 | B2 | 12/2016 | McDonald et al. | |
| 9,788,595 | B1 | 10/2017 | Heaven | |
| 2003/0074806 | A1 | 4/2003 | Urie | |
| 2005/0060914 | A1 * | 3/2005 | Fuerst | B29D 35/122 36/102 |
| 2005/0268485 | A1 | 12/2005 | Sukai | |
| 2006/0000116 | A1 * | 1/2006 | Brewer | A43C 5/00 36/11.5 |
| 2006/0059720 | A1 | 3/2006 | Phelan | |
| 2006/0288610 | A1 | 12/2006 | Laska | |
| 2008/0155855 | A1 * | 7/2008 | Klavano | A43B 3/122 36/51 |
| 2008/0276492 | A1 * | 11/2008 | Burnett | A43C 11/22 36/51 |
| 2009/0313854 | A1 | 12/2009 | Clarke | |
| 2010/0126045 | A1 * | 5/2010 | Rusnak | A43B 3/0036 12/146 D |
| 2012/0302135 | A1 | 11/2012 | Solotoff | |
| 2013/0118037 | A1 * | 5/2013 | Bathum | A43B 3/128 12/146 B |
| 2013/0160326 | A1 | 6/2013 | Szeheresh | |
| 2013/0318829 | A1 | 12/2013 | Opalacz | |
| 2014/0075783 | A1 | 3/2014 | Licht | |
| 2015/0027004 | A1 | 1/2015 | Conrad et al. | |
| 2015/0237950 | A1 | 8/2015 | Caldwell | |
| 2016/0113350 | A1 | 4/2016 | Sashen | |
| 2017/0027241 | A1 | 2/2017 | Solotoff | |
| 2017/0273379 | A1 | 9/2017 | Kyle | |
| 2017/0325540 | A1 | 11/2017 | Opalacz | |
| 2019/0320755 | A1 | 10/2019 | Opalacz | |

OTHER PUBLICATIONS

Unshoes, Introducing the Keota Sandal!, Oct. 28, 2015, downloaded from https://unshoes.wordpress.com/2015/10/28/introducing-the-keota-sandal/ on May 4, 2017.

* cited by examiner

ADJUSTABLE CLOG STYLE FOOTWEAR

CROSS-REFERENCE

This is a continuation of U.S. patent application Ser. No. 17/567,826, "Adjustable Clog", filed by the inventors Nicholas Pence and Daniel Opalacz on Jan. 3, 2022, now U.S. Pat. No. 11,805,858, issued on Nov. 7, 2023. Said patent is incorporated herein in its entirety.

FIELD OF THE INVENTION

The present invention relates generally to the field of footwear. More specifically, the present invention is a rugged, outdoor clog created for hiking and all-around outdoor usage.

BACKGROUND OF THE INVENTION

The present invention creates solutions to solve a number of problems related to the technical outdoor clog. These solutions relate to the durability, fit, and strap adjustability of the outdoor clog.

SUMMARY OF THE INVENTION

A clog is described here. The clog includes a sole assembly for the clog with an interior sole wing situated near the heel of the sole assembly, and an exterior sole wing on the opposite side of the sole assembly from the interior sole wing, near the heel of the sole assembly, wherein the interior sole wing and the exterior sole wing consist of webbing strap and rubber that extend above the sole assembly. The exterior sole wing includes a mechanical ring connected to the heel side of the exterior sole wing. The clog also includes an upper affixed to the sole assembly. A tab is connected to a paracord loop at the first end of the tab and the upper on the second end of the tab. A hook strap is affixed to the interior sole wing on the first end of the hook strap and to the paracord loop on the second end of the hook strap, where the hook strap includes a first G-hook that hooks into one of the first plurality of hook pockets. A first buckle strap piece is connected to the paracord loop on the first end of the first buckle strap piece and a mechanical connection device on the second end of the first buckle strap piece. A second buckle strap piece is connected through the mechanical connection device on the first end of the second buckle strap piece and to the exterior sole wing on the second end of the second buckle strap piece. A heel strap is connected to the interior sole wing on the first end of the heel strap and to the exterior sole wing on the second end of the heel strap through the mechanical ring. The heel strap includes a second G-hook that hooks into one of the second plurality of hook pockets.

The mechanical connection device could be a ladder lock buckle. The hook strap could be made up of two strap pieces sewn together. The two strap pieces could be sewn laterally to form the first plurality of hook pockets. The upper could be made of leather or canvas. The upper could be glued to the sole assembly. The sole assembly could include a midsole attached to a sole. The upper could be glued to the midsole. The sole assembly could include a footbed glued to the midsole.

An apparatus for wearing on a foot is also described here. The apparatus includes a sole assembly of the apparatus, where the sole assembly extends upward to form an interior wing and an exterior wing. An upper is affixed to the sole assembly. The apparatus further includes a G-hook and a hook strap made of strapping connected to the interior wing and the exterior wing, where the strapping includes a plurality of pockets for receiving the G-hook, where moving the G-hook to a different pocket adjusts the fit of the apparatus on the foot.

The G-hook could be attached to the end of the hook strap. The apparatus could be a clog. The plurality of pockets could be formed by stitching in a second piece of strapping on top of the hook strap. The G-hook could be made of plastic.

A second embodiment of an apparatus for wearing on a foot is also described here. The apparatus includes a sole of the apparatus, where the sole extends upward to form an interior wing and an exterior wing. The apparatus also includes a midsole glued to the sole between the interior wing and the exterior wing, the midsole including a channel between the interior wing and the exterior wing; a footbed glued to the midsole; an upper glued between the midsole and the footbed; and webbing of the apparatus, the webbing extending from the interior wing to the exterior wing between the footbed and the midsole, the webbing runs in the channel.

The sole could be made of a hard rubber material. The webbing could be sewn to the interior wing. The webbing could be folded over and sewn to the interior wing to form a loop. A heel strap could connect the interior wing to the exterior wing.

DETAIL DESCRIPTIONS OF THE INVENTION

Figure 1:
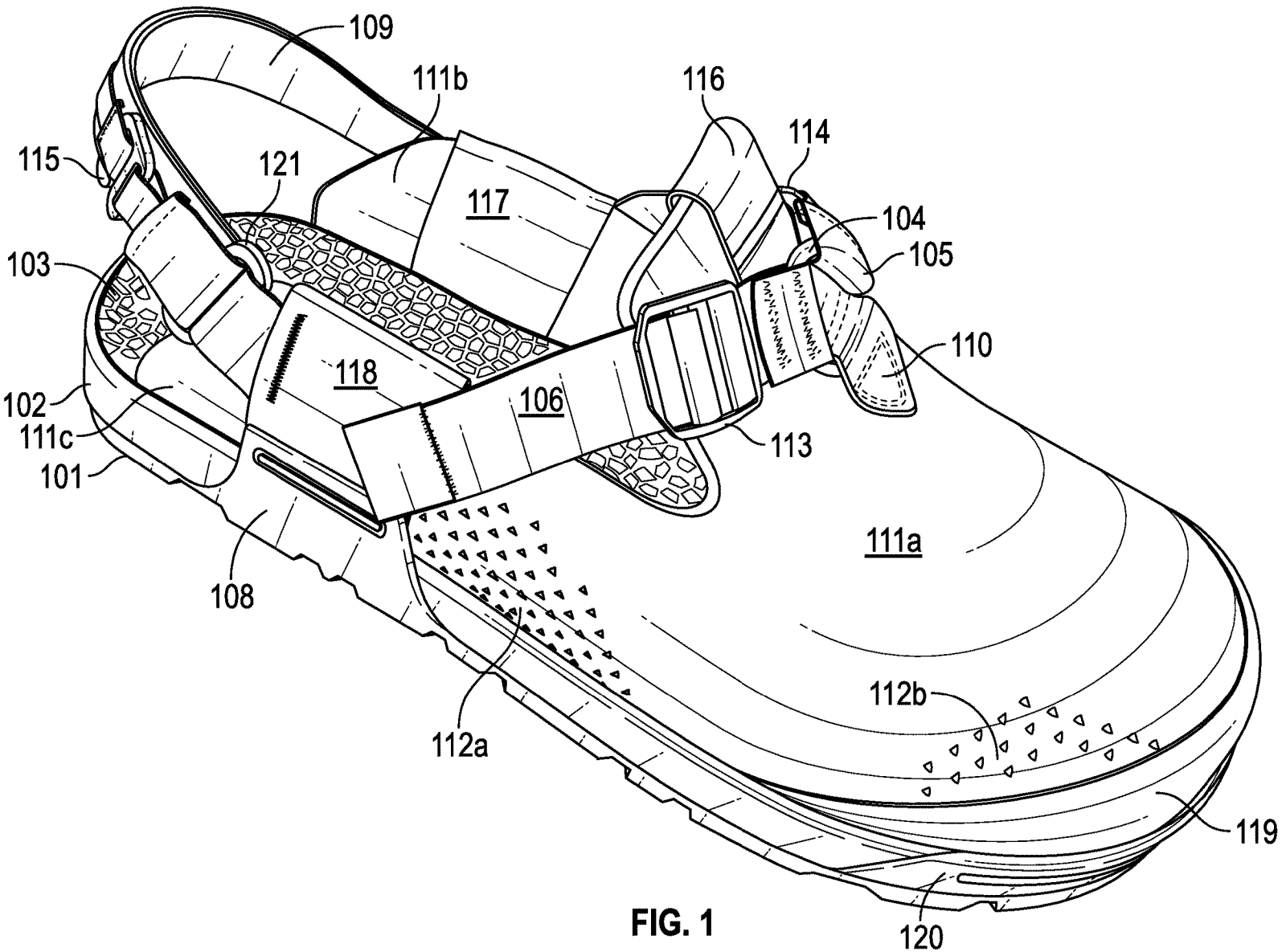
FIG. 1 is a perspective view illustration of the adjustable clog.

All illustrations of the drawings are for the purpose of describing selected versions of the present invention and are not intended to limit the scope of the present invention. The drawings and description herein reflect a right clog.

Strap System Overview

See also U.S. patent application Ser. No. 16/503,400, "Y-strap Sport Sandal", filed Jul. 3, 2019, now U.S. Pat. No. 11,129,434, issued on Sep. 28, 2021; U.S. patent application Ser. No. 15/587,499, "Y-strap Sport Sandal", filed by the inventors on May 5, 2017, now U.S. Pat. No. 11,793,263, issued on Oct. 24, 2023; U.S. Provisional Patent application 62/334,973, "Huarache Sport Sandal", filed by the inventors on May 5, 2016; and U.S. Provisional Patent Application 62/696,972, "Huarache Sport Sandal", filed by the inventors on Jul. 12, 2018. Each of these five patents and/or patent applications are included herein by reference in their entirety.

In the following description, the strapping described could be made of nylon, polyester, leather, rubber, plastic, cotton, elastic, or other materials. Similarly, the lacing could be made of paracord, nylon, polyester, leather, rubber, plastic, cotton, elastic, or other materials. The paracord loop, while made of paracord in the one embodiment, could be made of steel, aluminum, brass, other metals, plastic, polyester, nylon, leather, cotton, or other materials.

The present clog design contains three main webbing strap segments. The front two straps (hook strap 105, and ladder lock buckle strap 106) and the upper 111*a*, as can be seen in FIGS. 1-4 and 6, are all connected at the top of the foot by a soft and strong nylon paracord loop 104. The soft nylon loop 104 makes for a comfortable strap connection point that does not hurt the wearer's feet. The ladder lock buckle strap 106 is located on the outside of the wearer's feet for ease of use and comfort. The hook strap 105 is located on the inside of the wearer's foot. The third strap is the heel strap 109 and adjusts with a hook and loop fabric (such as Velcro®) through a metal loop hardware 121 in one embodiment. The loop hardware 121 could also be made of plastic, paracord, or other materials. In another embodiment, a G-hook heel strap 109 is used. The G-hook heel strap 109 also loops through the loop hardware 121 and the G-hook 115 hooks into one of the pockets 803*a-d*, allowing for adjustment.

Sole Assembly

The sandal strap system has 2 points anchored into the outsole 101, and the upper 111*a* connects to the sole around most of the clog. In the one embodiment, the outsole 101 is made of hard rubber material, such as Regolith™ Vibram® soles. The outsole 101, the midsole 102, the footbed 103, the toe guards 119,120, and the wings 107,108 could be made of hard rubber, leather, plastic, wood, polyurethane (PU), TPR (thermoplastic rubber, combination of polyurethane and rubber), TPU (thermoplastic polyurethane), TR/TPR, EVA (ethyl vinyl acetate), EVA/RUBBER, nitro polyvinyl chloride, Pebax, or other materials.

Figure 5:
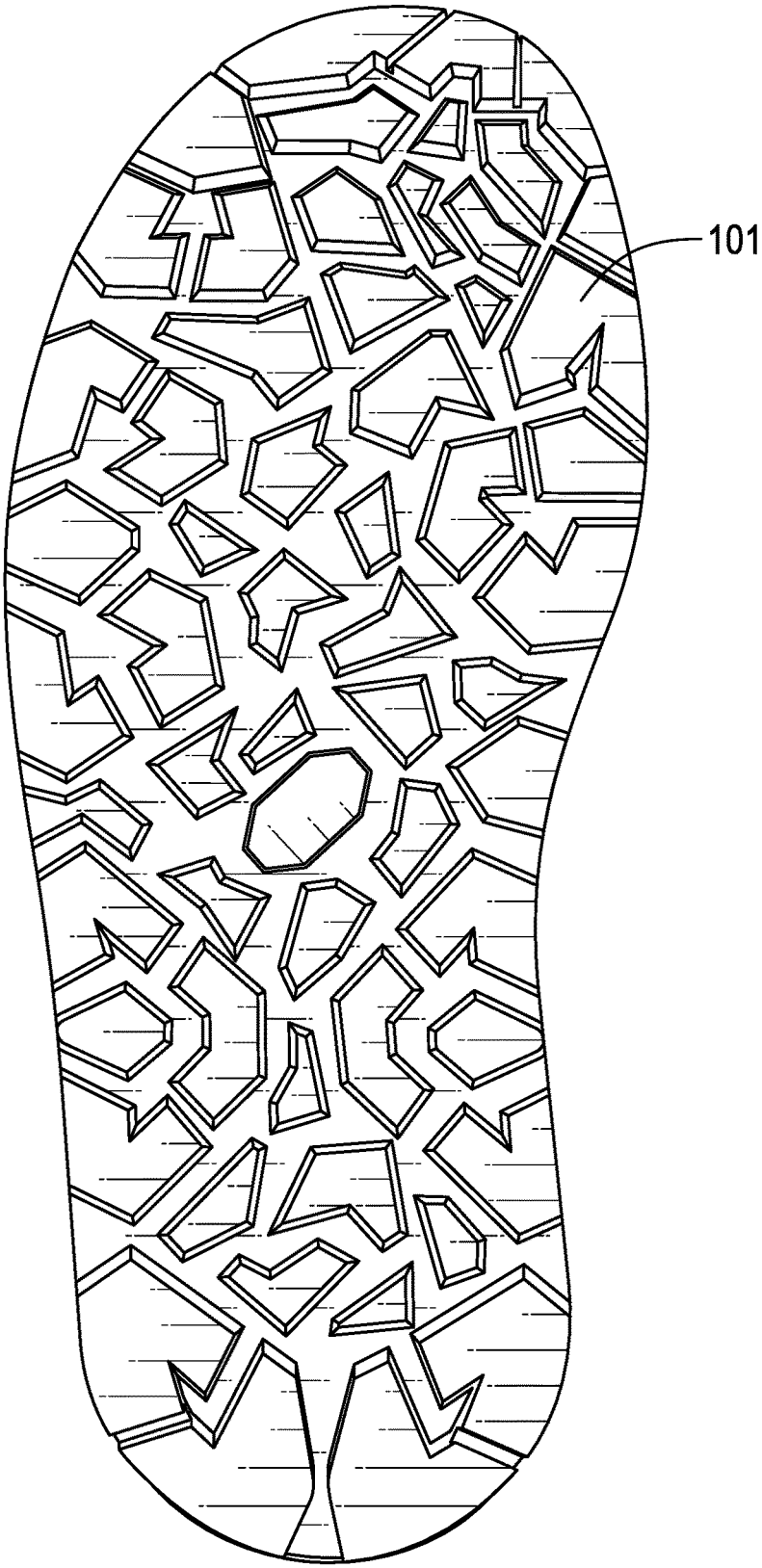
FIG. 5 is a bottom-view illustration of the adjustable clog.

The bottom of the sole 101 has a pattern for providing traction when walking or running. See FIG. 5. There are two anchor points located on the interior 107 and exterior 108 sides of the sole 101 by the wearer's ankle. The interior 107 and exterior 108 sides of the sole 101 are referred to as wings herein. The sole 101 could be molded to include the wings 107,108 as well as the toe guard 120 (and perhaps toe guard 119).

The hard rubber of the sole 101 extends upwards above the rest of the sole 101 on either side of the ankle to form an interior wing 107 and an exterior wing 108. These wings 107, 108 connect to wing straps 117,118. The wing straps 117 and 118 could be the same strap, running between the footbed 103 and the midsole 102. The wing straps 117 and 118 are connected to the heel strap 109, the hook strap 105, and the buckle strap 106.

In one embodiment, the sole 101 is glued to a midsole 102, and a footbed 103. The wings 107,108 are part of the mold for the sole 101. The midsole has a molded pattern and is glued in between the wings 107, 108. On the inside of the wings 107, 108, webbing 117, 118 is sewn to the hard rubber wings 107,108. The webbing runs from the interior wing 107 between the midsole 102 and the footbed 103 in a channel to the exterior wing 108, where it is again sewn. The webbing 117, 118 extends above the wings 107, 108 on both sides, and connects to the heel strap 109, the hook strap 105, and the buckle strap 106. This webbing 117,118 could be a single piece of webbing that runs through a cutout channel in the midsole 102, providing a connection for the webbing 117,118 on the interior wing 107 and the exterior wing 108. The midsole channel prevents an uneven surface on the foot side of the midsole 102.

The upper 111*a,b,c* is glued between the midsole 102 and the footbed 103 from the back to the front of the clog.

The sole 101 could have a toe guard 120 extending upwards on the front of the clog, protecting the midsole 102 and the footbed 103. The midsole 102 could have an additional toe guard 119 protecting the front of the footbed 103 and the upper 111*a*.

The midsole 102 could be molded to have an ergonomic shape on the footbed 103 to provide comfort to the user. The mold of the midsole 102 could incorporate the toe guard 119 in some embodiments.

Upper

A shaped piece of material called the upper 111*a,b,c* encompasses the front and top of the user's foot. The upper is glued to the midsole 102 and the footbed 103 around the circumference of the footbed 103. The upper 111*a,b,c* may be glued to the inside of the toe guards 119,120. At the top, the upper 111*a* could connect to the paracord loop 104 through tab 110. The tab 110 could extend over the top of the upper 111*a* as a tongue loop 116. In other embodiments, the tongue loop 116 is a separate piece of material.

The upper 111*a,b,c* could be made of leather (cowhide, pigskin, deerskin, ostrich skin, crocodile skin, snakeskin, etc.), canvas, polyvinyl chloride (PVC), polyurethane, nubuck leather, microfiber, mesh, nylon, metal net, cloth, suede, and similar materials.

In some embodiments, the upper 111*a,b,c* have vents 112*a,b,c,d* cut into the material. The vents 112*a,b,c,d* could vary in shape, size, number, and location.

In some embodiments, the upper 111*a* extends beyond the wings 107,108 to a back upper area 111*b*,111*c*.

In some embodiments, the upper 111*a,b,c* is sewn to the midsole 102. In some embodiments, the upper 111*a,b,c* is sewn to the sole 101. In other embodiments, the upper 111*a,b,c* is glued to the sole 101.

Adjustment Mechanisms and Features

Heel Strap

Figure 2:
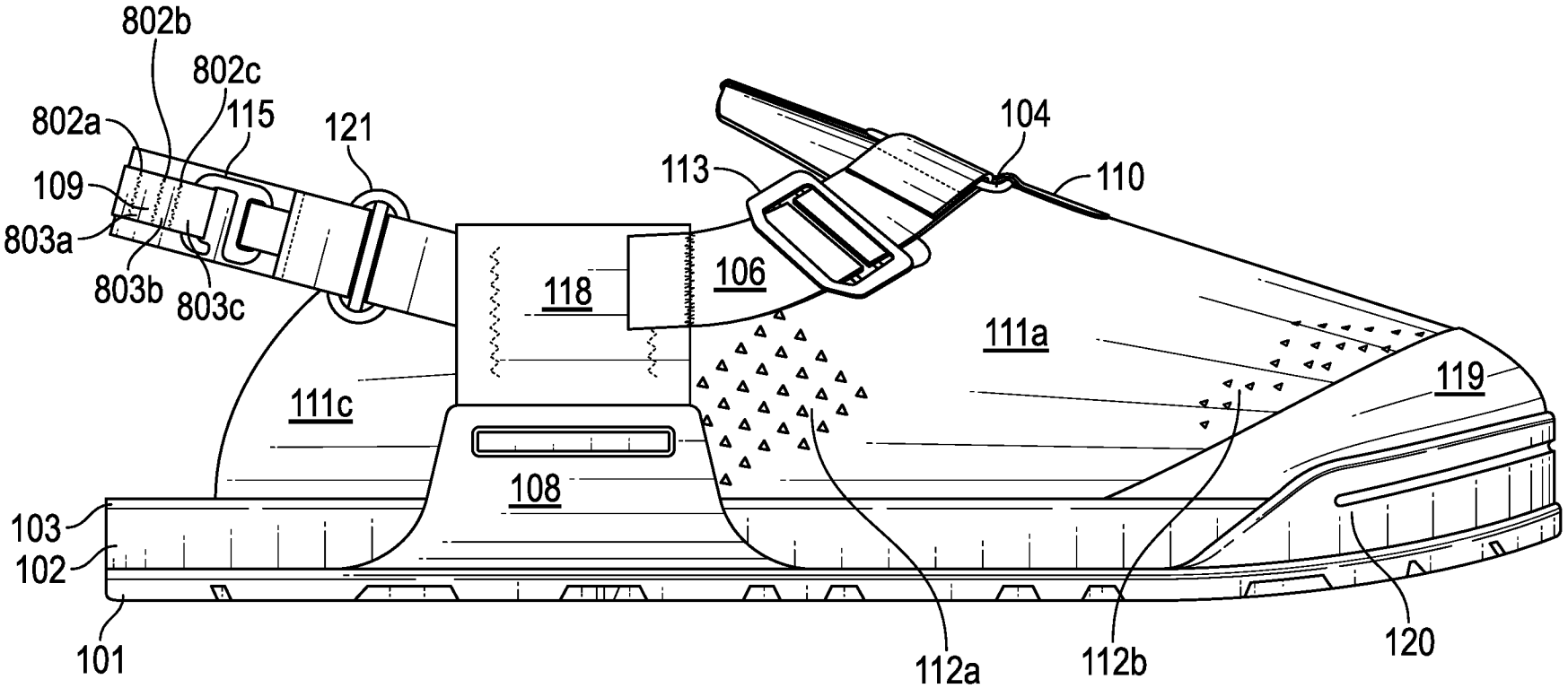
FIG. 2 is an outside-side view illustration of the adjustable clog.
Figure 7:
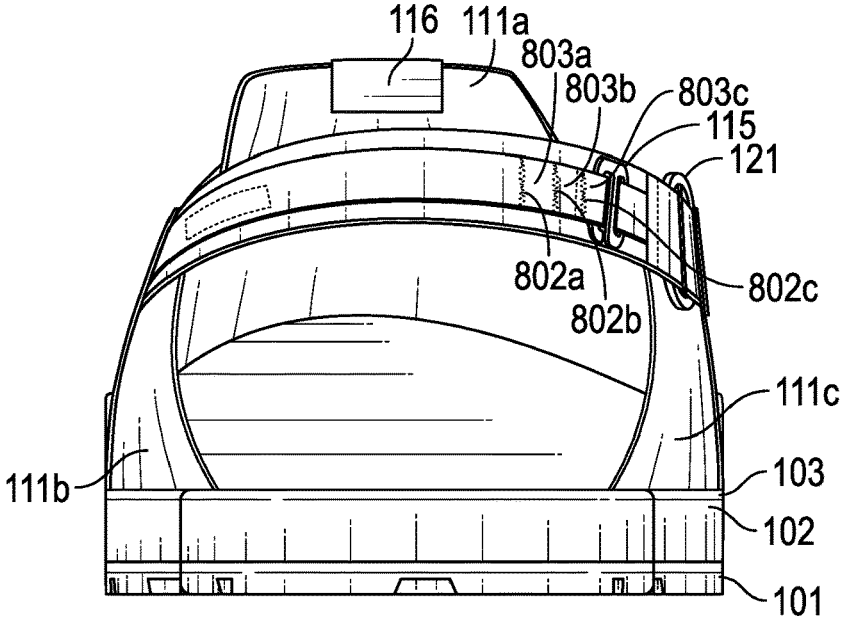
FIG. 7 is a rear-view illustration of the adjustable clog.

As seen in FIGS. 2 and 7, the heel strap 109 begins at the interior wing strap 117. The heel strap 109 is sewn together with polyester webbing on the outside and a loop and hook fabric (such as Velcro®) on the inside, in some embodiments. The heel strap is sewn to the interior wing strap 117 and wraps behind the heel, then through a metal loop 121 connected to the exterior wing strap 118. The heel strap 109 loop portion of the hook and loop fabric is facing away from the heel as the heel strap 109 threads through the mechanical ring 121, and the end of the heel strap 109 beyond the ring has the hook portion of the hook and loop fabric. The heel strap 109 folds through the mechanical ring 121 back on itself, adhering using the hook and loop fabric (Velcro®). The heel strap 109 gives quick and intuitive adjustment to tighten or loosen the sandal tightness at the hindfoot (the back of the foot above the heel). Note that Velcro® is a mechanical fabric hook and loop fastening system.

G-Hook Heel Strap

Figure 8:
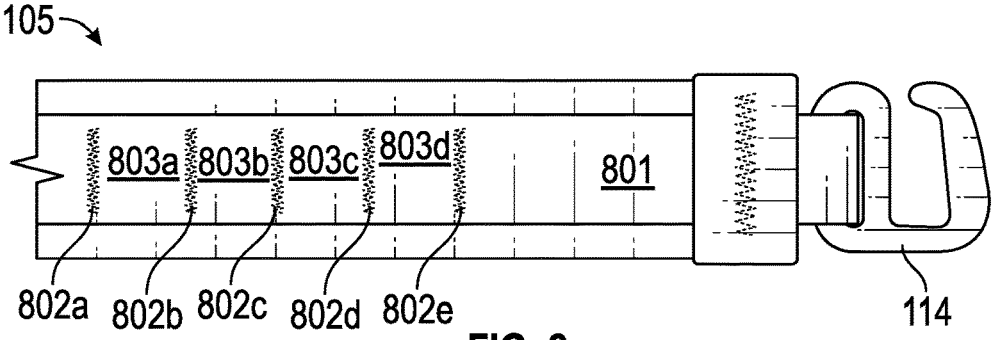
FIG. 8 is an illustration of the G hook and plurality of pockets on the heel strap.

In the alternative embodiment seen in FIG. 1,2,7, the heel strap 109 is replaced with a G-hook system as seen in FIG. 8. For wearers engaged in water activity as well as anything highly active in the outdoors, they may prefer a heel strap 109 that is more durable and less prone to fail than hook+loop Velcro. A heel strap 109 with one continuous piece of webbing will completely eliminate any chance of hook+loop heel strap delamination (failure) in wet and muddy conditions as well as found with long-term Velcro wear+tear from years of use. Although the single continuous webbing heel strap solves this durability issue, it offers no adjustment whatsoever, leaving wearers with a less than ideal fit. Typically, this creates a heel strap that is not secure and snug up against the heel.

We have used our G-hook technology to design a failure-proof heel strap that is completely adjustable to fit each unique wearer perfectly. The new G-hook heel strap 109 provides a customized fit that wearers seek, yet, will provide sturdy and failure-proof support while swimming, submerged in water, traversing muddy terrain, and in any environment whatsoever that would traditionally pose problematic for a hook+loop closure system. The G-hook heel strap 109 also provides far more long-term durability than a hook+loop alternative as there is no wear with continual adjustment use.

The G-hook heel strap 109 consists of at least two layers of webbing (webbing pile). A wider webbing (20 mm) 109 touches the wearer's heel, and a narrower webbing 801 matches the width of the G-hook 115 and is sewn into the wider webbing with Hook Pocket bartack stitches 803*a-c*. The webbing pile begins at the inside sole hugger wing strap 118, wraps around the foot and through an aluminum loop 121 (attached to the outside sole hugger wing strap 117), then wraps back around the foot, ending with the G-hook 115 which can hook into any variety of Hook Pockets 803*a-d*. The further the G-hook 115 wraps back towards the inside of the foot, hooking into an available Hook Pocket, the tighter the heel strap will fit the wearer. Depending on size there may be up to 10 hook positions 803*a-d* available for the G-hook adjuster. Once the G-hook 115 is hooked into the hook pockets 803*a-c*, the G-hook heel strap 109 will be fully secure for all outdoor activities.

A third layer of webbing may be sewn into the webbing pile of the G-hook heel strap 109 to provide the wearer with a cushion between the G-hook hardware 115 and the heel of their foot. The multiple layers of webbing help create a sturdy, yet comfortable heel strap. Alternatively, a thicker, more plush wide webbing can be used to create this layer of comfort.

Ladder Lock Buckle Strap Adjustment

The ladder lock buckle strap adjustment 113 is located on the outside of the foot. The buckle strap 106 is anchored to both the paracord loop 104 at one end and the exterior wing strap 118 at the other end. The buckle strap 106 is actually two pieces of webbing, a first buckle strap piece sewn in a loop around the paracord loop 104 at one end and the second buckle strap piece sewn in a loop around the ladder lock buckle 113 (or similar mechanical connection device 113). The second buckle strap piece of webbing is sewn to the exterior wing strap 118 at one end and loops through the ladder lock buckle 113 at the other end, allowing the user to pull the buckle strap 106 to shorten the length, thereby tightening the clog. The buckle strap 106 adjusts tightness through a ladder lock buckle 113. The ladder lock buckle 113 could be made of acetal plastic in one embodiment, but could also be made of could also be made of aluminum, steel, stainless steel, zinc alloys, brass, bronze, titanium, other metals, carbon fiber, polypropylene, nylon, plastics, or similar materials. Tugging the tag end of webbing 106 through the buckle 113 tightens the system. This adjusting mechanism is simple to use and is used as an everyday adjuster for tightening, loosening, putting the clogs on, and taking them off.

Hook Strap

Figure 3:
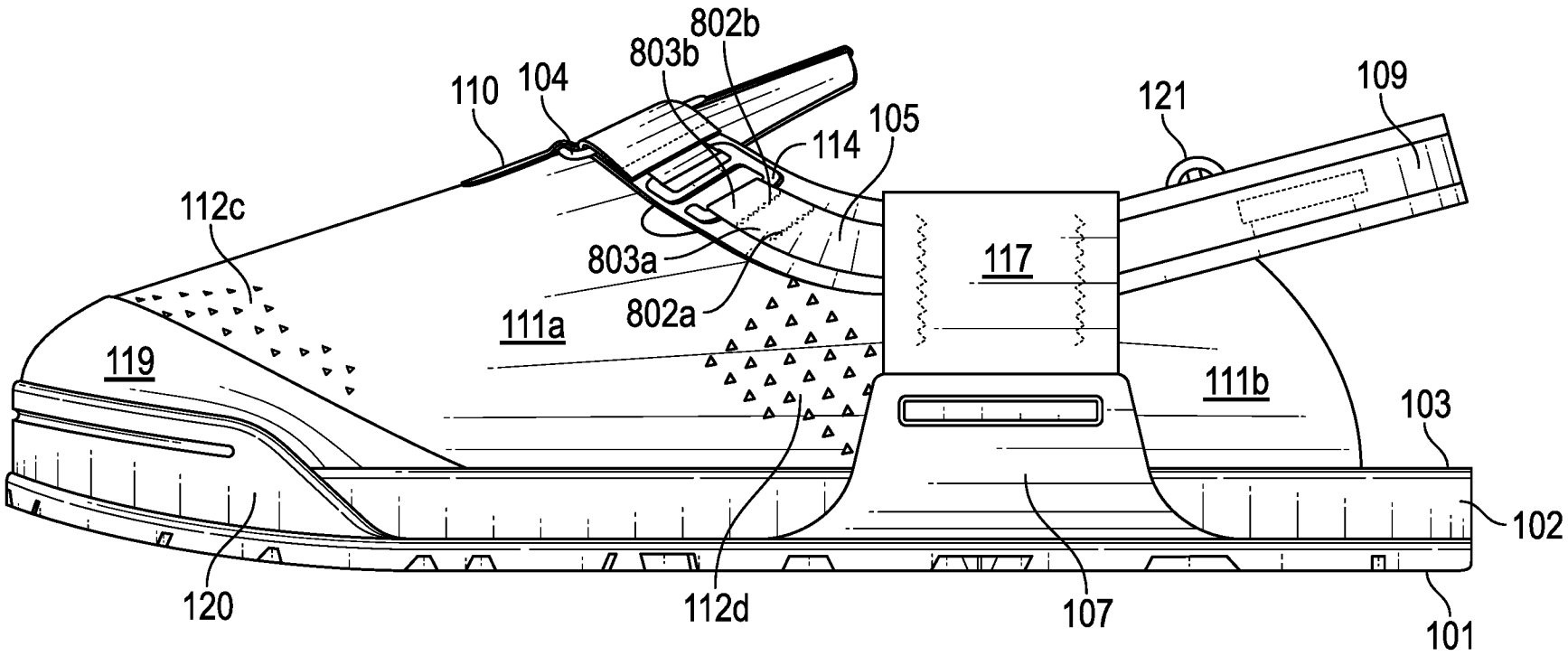
FIG. 3 is an inside-side view illustration of the adjustable clog.
Figure 4:
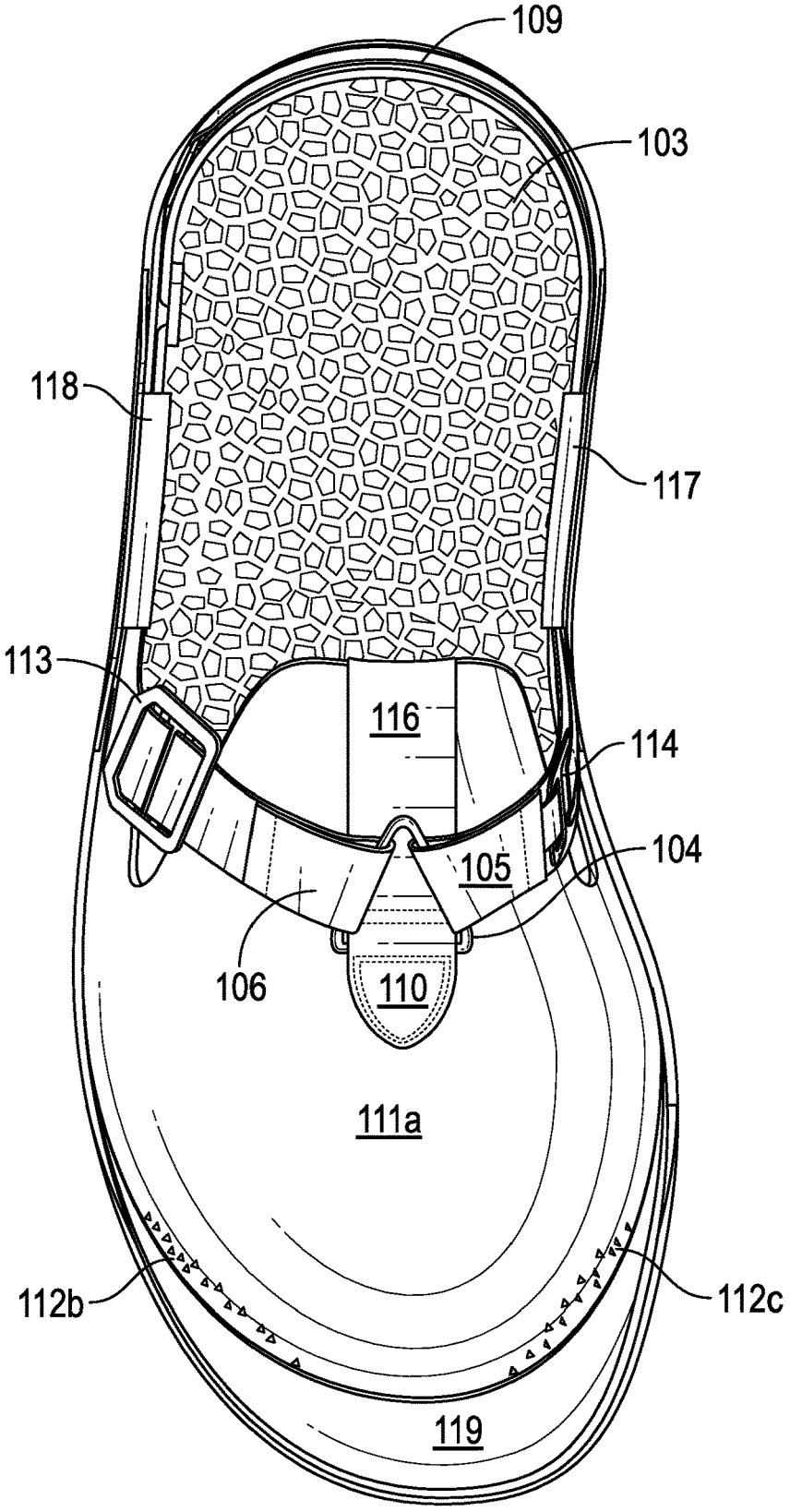
FIG. 4 is a top-view illustration of the adjustable clog.

As seen in FIG. 3 and FIG. 4, the hook strap 105 serves as an extremely useful mechanism for customizing the fit of the sandal for each wearer's preferences during both casual and intense activities. The hook strap 105 tightens or expands the overall volume of the strap system and controls the angle at which the upper 111*a* strikes the top of the wearer's foot. It is critical to be able to adjust the angle of the upper 111*a* on the clog for ideal comfort through various activities and for various foot sizes. The hook strap 105 creates an ideal mechanism for this adjustment process as it is very flexible, comfortable, durable, and strong. Unlike a hook and loop fabric (Velcro®) adjuster in this area, the hook strap 105 will not come undone during water activities like swimming, and cliff jumping.

The hook strap 105 could be composed of a custom-molded plastic ½" G-hook 114, two different widths of webbing 105, 801, and a series of bartack stitches 802*a-e*. The narrower ½" webbing 801 is sewn into the wider ¾" polyester tubular webbing 105 at consistent intervals. In between each of these bartacks 802*a-e* leaves a ½" long gap (hook pocket) 803*a-d* between the ½" and ¾" straps for the G-hook 114 to fit in. The G-hook 114 is sewn to the end of flat ½" webbing 801 and is the terminating point of the hook strap 105. The G-hook 114, 115 could also be made of different sizes and materials such as aluminum, steel, stainless steel, zinc alloys, brass, bronze, titanium, other metals, carbon fiber, acetal, polypropylene, nylon, plastics, or similar materials.

The non-hook end of the Bedrock Hook strap 105 is sewn into the front end of the interior wing strap 117. The hook strap 105 is then looped through the paracord loop 104 back on itself. The G-hook 114 then has 3-5 different ½" long hook pockets 803*a-d* between the ½" webbing 801 and ¾" webbing 105 to hook into. This range gives the wearer the ability to tighten or loosen the hook strap 105 and thus change the orientation of the upper 111*a*. Of course, the size of the strapping here and throughout this document could be varied without deviating from the design.

Sole Wings

The sole wings 107,108 provide wearers with more lateral stability and comfort compared to a traditional clog design. The sole wings 107, 108 and their straps 117,118 provide two strong and durable anchor points for the strap system to connect to on either side of the wearer's ankle. There are two sole wings, an interior sole wing 117 on the inside of the clog, and an exterior sole wing 118 on the outside of the clog.

The wing consists of both a 1.5-inch-wide webbing straps 117, 118 and rubber wings 107, 108 from the sole 101 that wrap up and above the midsole 102 and the footbed 103. The 1.5-inch-wide webbing runs as a continuous piece above the midsole 102 in a channel between the midsole 102 and the footbed 103. The webbing 117,118 is then folded over and sewn into the rubber wing 107, 108. This fold creates two gaps (front and back) for the Bedrock Cairn Strap System 105,106,109 to connect to.

Figure 6:
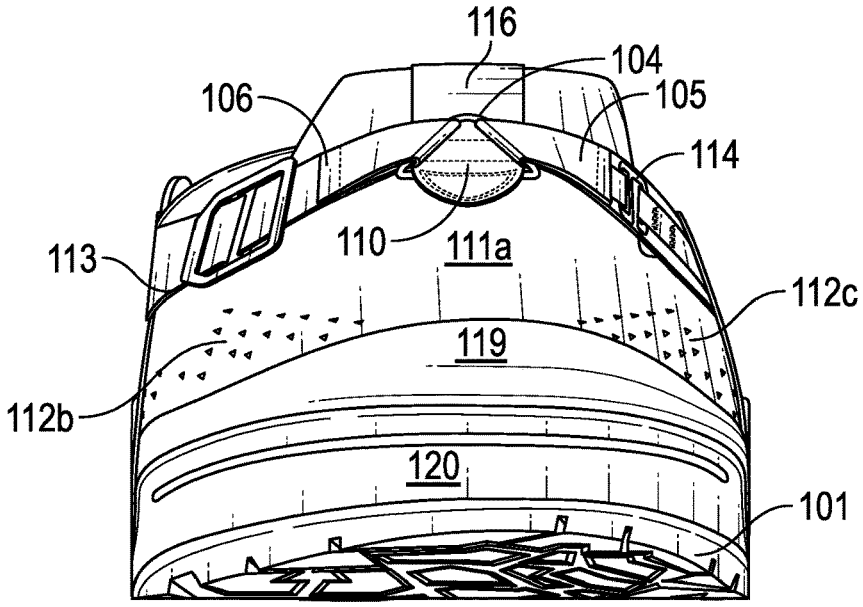
FIG. 6 is a front-view illustration of the adjustable clog.

FIG. 6 shows the front view of the clog. The sole 101 with its toe guard 119 is at the bottom of the figure. The toe guard 119 could be molded into the sole 101 or glued to the sole 101. The second toe guard 119 could be molded into the midsole 102 or glued to the midsole 102. Alternatively, the second toe guard 119 could be molded into the first toe guard 120 or glued to the first toe guard 120. Upper 111*a* is glued to the midsole 102 and the footbed 103, and may be glued to the toe guards 119,120. The tab 110 is sewn into the upper 111*a* and attaches to the paracord loop 104. The buckle strap 106 loops through the paracord loop 104 and back to the buckle 113. The G-hook strap 105 loops through the paracord loop 104 and back to the G-hook 114. The G-hook is inserted into the pockets 803*a,b,c,d*. In FIG. 6, the G-hook 115 is in pocket 803*b*, and pockets 803*c,d* are not visible behind the G-hook 114.

FIG. 7 shows a rear view of the clog, with a view of the inside of the clog. The sole 101 forms the base, with the midsole 102 glued to the sole 101, and the footbed 103 glued to the midsole 102. The upper 111*a,b,c* can be seen on the sides and the top. The upper 111*a,b,c* is glued between the midsole 102 and the footbed 103. The heel strap 109 loops through the loop 121 and back on itself where the G-hook 115 hooks into the pockets 803*a,b,c,d*. In FIG. 7, the G-hook 115 is in pocket 803*c*, and pocket 803*d* is not visible behind the G-hook 115.

The foregoing devices and operations, including their implementation, will be familiar to, and understood by, those having ordinary skill in the art.

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

The invention claimed is:

1. An apparatus for wearing on a foot, comprising:

a sole assembly of the apparatus, the sole assembly extends upward to form an interior wing and an exterior wing;

a closed upper affixed to a periphery of a front of the sole assembly, where the closed upper and the sole assembly are configured to enclose a front and top of the foot;

a tab affixed to the closed upper and affixed to a paracord loop;

a hook strap affixed to the interior wing via the interior wing strap at a first end of the hook strap and connected to the paracord loop at a second end of the hook strap by looping the hook strap through the paracord loop and inserting a G-hook at the second end of the hook strap into one of a plurality of pockets in the hook strap.

2. The apparatus of claim 1 where moving the G-hook to a different pocket adjusts a fit of the apparatus on the foot.

3. The apparatus of claim 1 wherein the apparatus is a clog.

4. The apparatus of claim 1 wherein the plurality of pockets are formed by stitching in a second piece of strapping on top of the hook strap.

5. The apparatus of claim 1 wherein the G-hook is made of plastic.

6. The apparatus of claim 1 wherein the closed upper is made of leather.

7. The apparatus of claim 1 where the closed upper has vents.

8. An apparatus for wearing on a foot, comprising:

a sole of the apparatus, the sole extends upward to form an interior wing and an exterior wing;

a midsole above the sole, the midsole including a channel between the interior wing and the exterior wing;

a closed upper attached to a periphery of a front of the midsole, where the closed upper and the midsole are configured to enclose a front and top of the foot;

a tab affixed to the closed upper and affixed to a paracord loop;

a hook strap affixed to the interior wing via the interior wing strap at a first end of the hook strap and connected to the paracord loop at a second end of the hook strap by looping the hook strap through the paracord loop and inserting a G-hook at the second end of the hook strap into one of a plurality of pockets in the hook strap; and webbing of the apparatus, the webbing extends from the interior wing to the exterior wing between the sole and the midsole, the webbing runs in the channel.

9. The apparatus of claim 8 wherein the sole comprises a hard rubber material.

10. The apparatus of claim 8 wherein the webbing is sewn to the interior wing.

11. The apparatus of claim 10 wherein the webbing is folded over and sewn to the interior wing to form a loop.

12. The apparatus of claim 8 further comprises a heel strap connecting the interior wing to the exterior wing.

13. The apparatus of claim 8 wherein the closed upper is affixed to the midsole around at the front of the midsole.

14. The apparatus of claim 8 wherein the closed upper is made of mesh.

15. An apparatus for wearing on a foot, comprising:

a sole assembly of the apparatus, the sole assembly extends upward to form an interior wing and an exterior wing;

a closed upper affixed to a periphery of a front of the sole assembly, where the closed upper and the sole assembly are configured to enclose a front and top of the foot;

a tab attached to a top of the closed upper;

a paracord loop connected to the tab;

a hook strap affixed to the interior wing via the interior wing strap at a first end of the hook strap and connected to the paracord loop at a second end of the hook strap by looping the hook strap through the paracord loop and inserting a G-hook at the second end of the hook strap into one of a plurality of pockets in the hook strap.

16. The apparatus of claim 15 where moving the G-hook to a different pocket adjusts a fit of the apparatus on the foot.

17. The apparatus of claim 15 wherein the apparatus is a clog.

18. The apparatus of claim 15 wherein the plurality of pockets are formed by stitching in a second piece of strapping on top of the hook strap.

19. The apparatus of claim 15 wherein the loop is made of plastic.

* * * * *